US005221929A

United States Patent [19]

Ott

[11] Patent Number: 5,221,929

[45] Date of Patent: Jun. 22, 1993

[54] HINGED MAGNETIC ANTENNA MOUNT

[76] Inventor: Russell J. Ott, 9050 Briarclift Rd., Indianapolis, Ind. 46256

[21] Appl. No.: 717,975

[22] Filed: Jun. 20, 1991

[51] Int. Cl.[5] ..... H01Q 1/32

[52] U.S. Cl. ..... 343/715; 343/881; 343/882

[58] Field of Search ..... 343/715, 711, 712, 900, 343/901, 903, 915; 248/467, 472, 683

[56] References Cited

U.S. PATENT DOCUMENTS

| | | | |
|---|---|---|---|
| 3,579,241 | 5/1971 | Antista et al. | 343/901 |
| 4,101,897 | 7/1978 | Morrison | 343/715 |
| 4,293,860 | 10/1981 | Iwata | 343/715 |
| 4,692,770 | 9/1987 | Kadokura | 343/711 |
| 4,882,592 | 11/1989 | Studer, Jr. et al. | 343/900 |

FOREIGN PATENT DOCUMENTS

| | | | |
|---|---|---|---|
| 0302029 | 2/1989 | European Pat. Off. | 248/683 |
| 2397075 | 3/1979 | France | 343/713 |
| 2552936 | 4/1985 | France | 363/715 |
| 0023763 | 2/1980 | Japan | 248/467 |

*Primary Examiner*—Michael C. Wimer

*Assistant Examiner*—Tan Ho

*Attorney, Agent, or Firm*—Woodard, Emhardt, Naugton, Moriary & McNett

[57] ABSTRACT

An auxiliary antenna assembly suitable for use on most vehicles includes a magnetic base unit that can be magnetically mounted upon any appropriate surface of the vehicle. An antenna support platform is connected to the base unit by a hinge. The support platform is made at least partially from a ferromagnetic material so that it will form a magnetic bond against the base unit. The amount of ferromagnetic material in the support platform is such that the bond between the base unit and the vehicle is significantly stronger than the bond between the base unit and the support platform. The support platform can rotate about the hinge when the bond between the base unit and the support platform is broken. The support platform also includes a means for connecting an antenna thereto and a coaxial cable connection from the attached antenna to an item of radio equipment carried by the vehicle. The hinge between the base unit and the support platform allows the antenna to yield to obstructions without dislodging the complete antenna assembly from the vehicle.

8 Claims, 3 Drawing Sheets

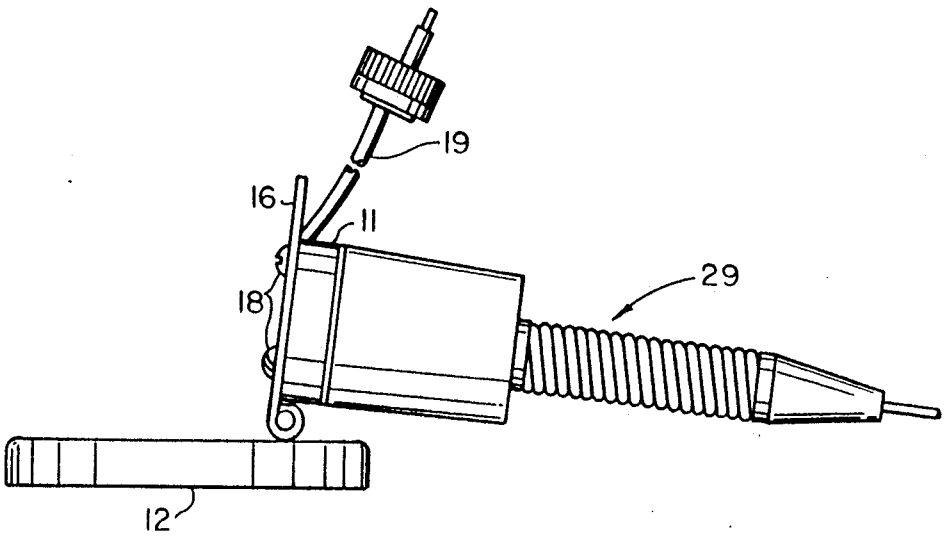
Fig.4
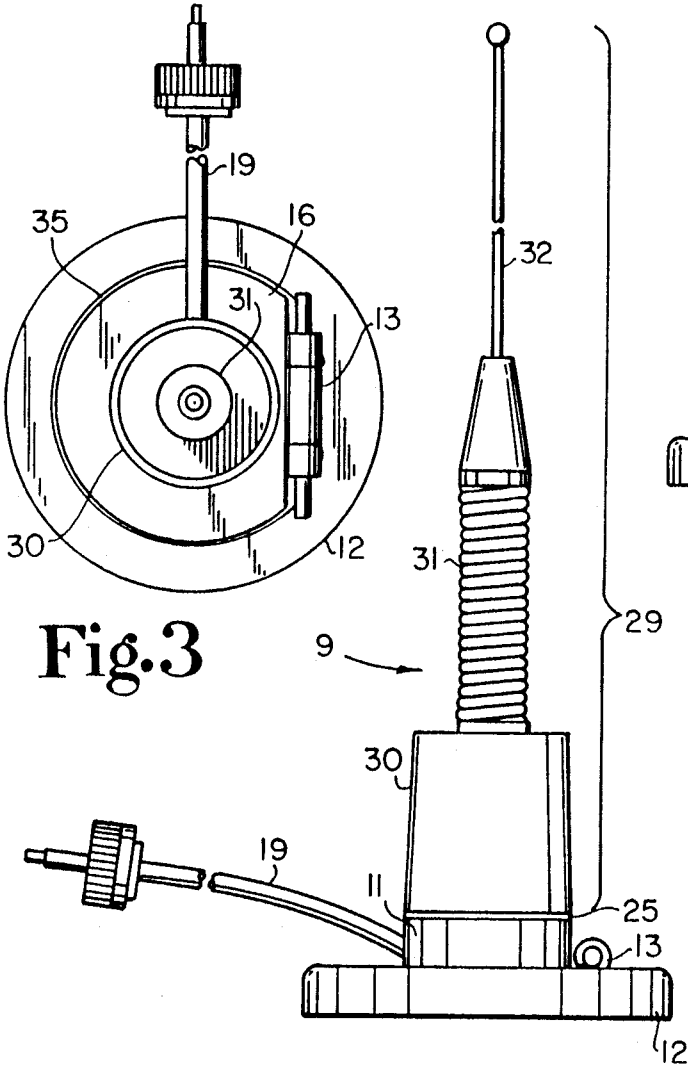
Fig.2
Fig.3

HINGED MAGNETIC ANTENNA MOUNT

BACKGROUND OF THE INVENTION

The present invention relates generally to externally mounted accessory antennas for vehicles. In particular, the invention relates to foldable antennas which are magnetically mountable on vehicles. Such vehicles include but are not limited to cars, trucks, farm machinery, boats or any of a number of other specialized vehicles that often do not include a communication antenna as original equipment.

Often persons find it desirable or advantageous to add communication equipment, such as a citizen's band radio, to their vehicle. Auxiliary antennas for such radios must correspondingly have the ability to be mounted upon a wide variety of vehicles. Manufacturers have found that antennas having a magnetic base are suitable for use on most vehicles because almost every vehicle includes at least one ferromagnetic surface. In other words, most vehicles include steel sheet metal somewhere on their exterior construction which is suitable to receive an antenna thereon. Such auxiliary antennas typically consist of a magnetic base unit, an antenna mounted upon the base unit and a coaxial cable connection between the antenna and the item of radio equipment in the vehicle. The magnetic base unit gives the buyer needed flexibility in deciding where on their vehicle they wish to mount the antenna. This flexibility is especially important to those persons having specialized vehicles, such as farmers, that often have limited space available for antennas.

One problem that has persisted with the use of auxiliary antennas of this type is that the strength of the attachment to the vehicle is only as strong as the magnet in the base unit. What this means in practice is that the antenna assemblies can be easily removed when desired but, unfortunately, they also have the potential of being dislodged from their original mounting location due to some disturbing force acting on the antenna. In other words, because the antenna normally extends above the vehicle, the antenna can strike an obstruction when the vehicle is driven into a shelter. The problem of the antenna becoming dislodged is especially critical when the antenna has the possibility of falling into machinery carried by the vehicle, often resulting in a destroyed antenna and damaged machinery. One example of this could be an antenna mounted upon a tractor. If the farmer forgets to remove the antenna each time he drives into his barn, he runs the risk that the antenna could be dislodged and fall into some undesirable location on or near the tractor resulting in a destroyed antenna and damaged farm machinery.

What is needed is an auxiliary antenna assembly that retains the flexibility provided by a magnetic base unit but which is not subject to becoming dislodged from the vehicle when the antenna strikes an obstruction. In particular, what is needed is an antenna which tends to remain upright but which is capable of yielding to an obstruction without dislodging the base unit from its intended mounting location.

SUMMARY OF THE INVENTION

An auxiliary antenna assembly according to one embodiment of the present invention comprises a magnetic base unit capable of being magnetically mounted upon any suitable exterior surface of a vehicle. A hinge interconnects an antenna support platform to the base unit.

The antenna support platform is composed of a significant amount of ferromagnetic material which is attracted to the magnetic base unit. The support platform includes a means for attaching an antenna thereto. When a disturbing force acts upon the antenna, such as when a tractor is driven underneath a shelter, the magnetic bond between the base unit and the antenna support platform is broken. However, a stronger magnetic bond between the vehicle and the base unit is undisturbed. When the magnetic bond between the support platform and the base unit is broken, the antenna and its support platform rotate about the hinge to assume a horizontal position out of the way of the overhead structure that caused the disturbing force. In this way, the antenna assembly remains mounted at its original location on the vehicle, out of the way of the obstruction, rather than becoming dislodged and falling into the farm machinery or some other undesirable location.

A method of mounting an auxiliary antenna assembly on a vehicle in the face of certain disturbing forces is also disclosed. The method comprises a first step of providing an antenna assembly having a magnetic base unit, an antenna, and a hinge which defines an axis of rotation and which interconnects the base unit to the antenna. The second step comprises magnetically mounting the base unit of the assembly at a suitable location on a vehicle such that the axis of rotation is substantially aligned with an axle of the vehicle. When the antenna experiences a transverse force, such as when a combine is driven into a barn and the antenna projects above the door opening, the antenna will rotate about the hinge to assume a horizontal position clear of the obstruction rather than having the complete antenna assembly dislodged from the vehicle.

One object of the present invention is to provide an improved vehicle antenna assembly.

Another object is to provide an antenna assembly that avoids the risk and consequences of being dislodged from its mounting location on a vehicle.

Related objects and advantages of the present invention will be apparent from the following description.

BRIEF DESCRIPTION OF THE DRAWINGS

FIG. 2 is a side elevational view of an auxiliary antenna assembly according to the preferred embodiment of the present invention.

FIG. 3 is a top plan view of the mounting portion shown in FIG. 1.

FIG. 4 is a side elevational view of the auxiliary antenna assembly of FIG. 2 when the antenna support platform has been rotated about the hinge with respect to the base unit.

DESCRIPTION OF THE PREFERRED EMBODIMENT

Figure 1:
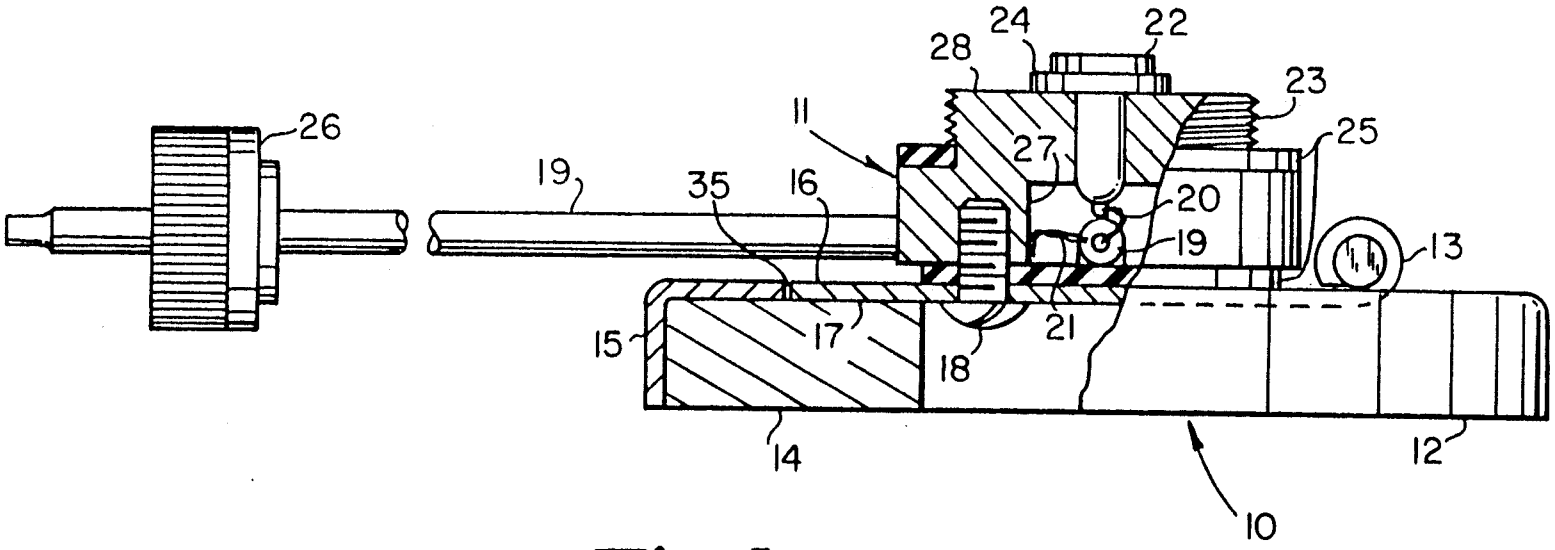
FIG. 1 is a partially sectioned side elevational view of the mounting portion of an auxiliary antenna assembly according to the preferred embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings, there is shown in FIG. 1 mounting portion 10 of an auxiliary antenna assembly according to the preferred embodiment of the present invention. Mounting portion 10 includes a magnetic base unit 12 with antenna support platform 11 connected to it by hinge 13. Base unit 12 includes a donut shaped ceramic magnet 14 which is partially encased by wall 15, which is preferably formed of metal with some aesthetically pleasing coating such as chrome thereon. Antenna support platform 11 includes ferromagnetic plate 16 and pedestal 28 that are attached to one another by screws, such as screw 18 as shown. Pedestal 28 is preferably formed from a single piece of electrically conductive material. Ferromagnetic plate 16 includes abutment surface 17 which normally rests against and forms a magnetic bond to magnet 14. A coaxial cable 19 enters the rear of support platform 11 into cavity 27 and is held in place by being wedged between plate 16 and pedestal 28. Cable 19 includes an inner wire 20, an outer braided wire sheath 21 and connection means 26. Inner wire 20 is connected to antenna contact 22 but is electrically isolated from pedestal 28 by plastic liner 24. Outer braided wire sheath 21 is connected directly to pedestal 28 and forms the second connection to the antenna when the remainder of the antenna whip assembly (see remaining figures) is attached to pedestal 28 via threads 23. Two rubber washers 25 are also included, but neither is actually necessary to the proper functioning of the antenna assembly. One rubber washer is added below threads 23, and the other is situated between ferromagnetic plate 16 and pedestal 28.

FIG. 2 shows a complete auxiliary antenna assembly 9 according to the preferred embodiment of the present invention. Auxiliary antenna assembly 9 includes mounting portion 10, as previously described, and antenna whip assembly 29, which is of the type currently available on the market. Whip assembly 29 includes antenna whip 32, shock spring 31 and attachment support 30, all of which are well known in the art and connected to each other by conventional means. Whip assembly 29 is connected to mounting portion 10 by screwing attachment support 30 onto support platform 11 via threads 23 (shown in FIG. 1). Rubber washer 25 provides a shock absorbing layer between support platform 11 and attachment support 30.

FIG. 3 shows a top plan view of the mounting portion shown in FIG. 1, and affords another view of magnetic base unit 12 and support platform 11, both of which are made circular in this case. Also shown from another perspective is ferromagnetic plate 16 which is preferably a piece of steel. Plate 16 is formed at one side into a portion of hinge 13 and is otherwise cut in a circular shape to be received into a central aperture 35 which has been cut out of wall 15 (see FIG. 1) of base unit 12 and abuts against the top of ceramic magnet 14.

The magnetic bond between the ceramic magnet 14 in base unit 12 and the ferromagnetic plate 16 holds support platform 11 and antenna whip assembly 29 in an upright position as shown in FIG. 2. However, if a sufficient torque is applied around hinge 13 support platform 11 together with antenna whip assembly 29 rotate about the hinge away from base unit 12 to assume a substantially horizontal position, as shown in FIG. 4. In other words, a transverse force acting upon antenna 32 can produce a torque of sufficient strength to break the magnetic bond between base unit 12 and support platform 11, but without dislodging the base unit from its mounting location on the vehicle.

Figure 5:
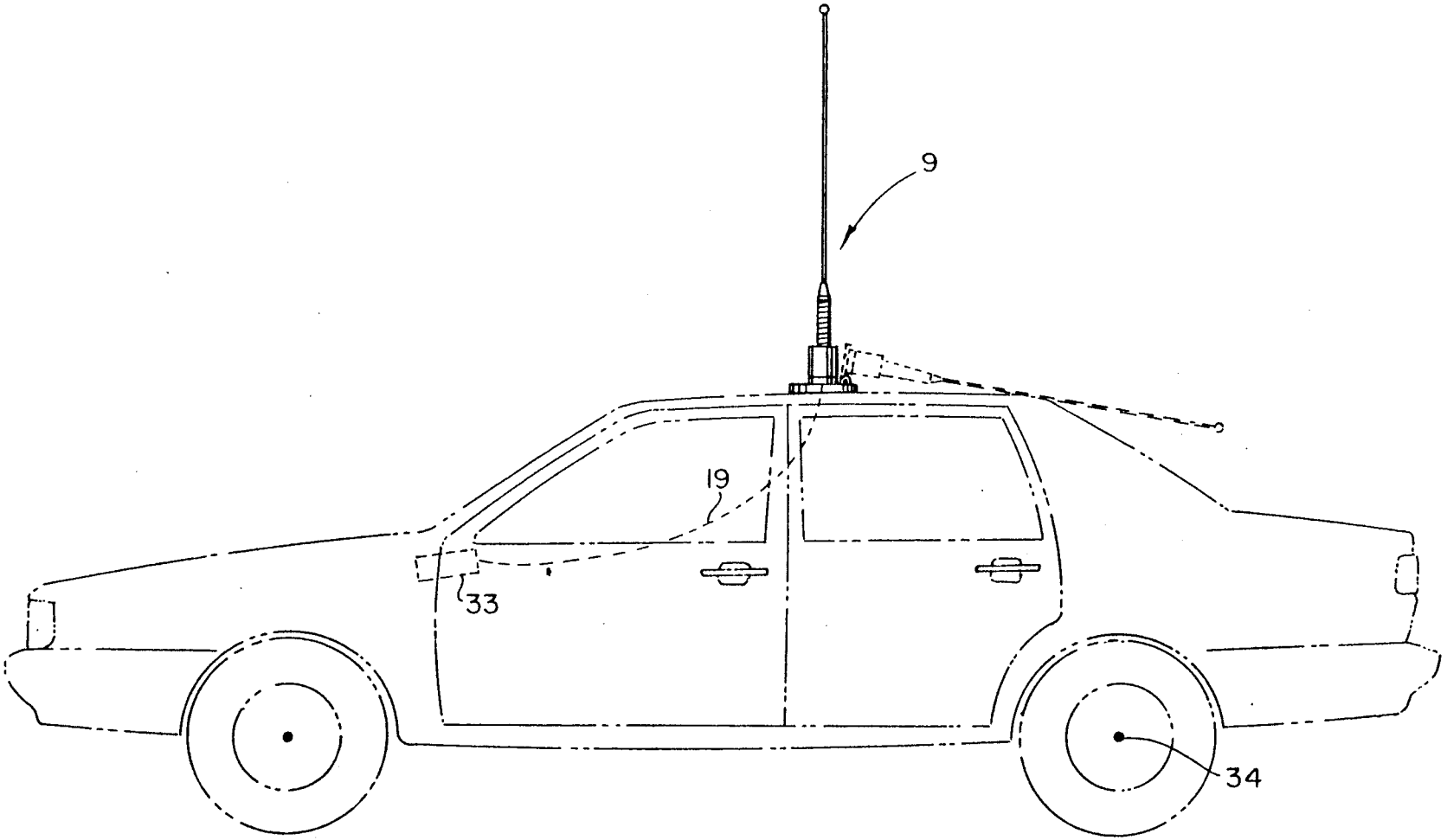
FIG. 5 is a side elevational view of the auxiliary antenna assembly of FIG. 2 mounted upon a car.

FIG. 5 shows auxiliary antenna assembly 10 magnetically mounted on the top of a car. In this case, coaxial cable 19 is connected to an item of radio equipment 33 within the car. Antenna assembly 10 is mounted so that hinge 13 is aligned with the axle 34 of the car because the antenna is most likely to encounter an obstruction when the car is being driven forward, such as into a garage. Conventional auxiliary antennas, even when combined with the usual shock spring 31 but which do not include the innovative hinge feature of the present invention, can be completely dislodged from their mounting location if the antenna encounters a significant obstruction. While the likelihood of this happening might be less in the case of automobiles because of the height of the vehicle, there are other vehicles such as trucks and farm machinery that often have much less clearance between the vehicle and the potential obstruction, such as the upper portion of a barn door opening. The consequences of dislodging the antenna assembly from a piece of farm machinery can also be more severe than in the case of an automobile. The dislodged antenna could fall into the machinery, such as a combine, destroying the antenna and wreaking havoc in the internal mechanisms of the farm equipment.

If an antenna assembly embodying the present invention is utilized, the antenna simply folds over to assume a substantially horizontal position (as shown in FIG. 4 and in shadow in FIG. 5) when the antenna yields to an obstruction. However, it is important for the proper functioning of the present invention that the magnetic bond between the base unit and the vehicle be somewhat stronger than the magnetic bond between the base unit and the antenna support platform. This is to ensure that the bond between the base unit and the support platform gives way first, leaving the base unit undisturbed with respect to its mounting position on the vehicle. The strength of the bond between the support platform and the base unit is determined simply by the amount and spacial distribution of the ferromagnetic material which is included in the construction of the support platform.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An auxiliary antenna assembly for a vehicle comprising:

a base unit;

an antenna support platform;

a hinge interconnecting said base unit to said support platform;

an antenna mounted upon said support platform;

means for connecting said antenna to an item of radio equipment carried by the vehicle;

said base unit including a magnet secured therein which allows said base unit to be magnetically mounted upon the exterior of a vehicle; and said support platform being composed of a significant amount of ferromagnetic material which is magnetically attracted to said magnet and held in position on the base unit by the magnet.

2. The auxiliary antenna assembly of claim 1 wherein, said significant amount of ferromagnetic material in said support platform is offset with respect to the hinge and is sufficient to produce a restraining torque about said hinge which tends to hold said support platform in abutment with said base unit, and said restraining torque is capable of being overcome by an opposing torque about said hinge without dismounting the base unit from the vehicle.

3. A magnetic mounting portion for an auxiliary antenna assembly to be used on a vehicle comprising:

a magnetized base unit;

an antenna pedestal having means for attaching an antenna thereon; and a hinge having a rotational axis and interconnecting said antenna pedestal to said magnetized base unit, the antenna pedestal having a portion offset from the hinge axis and magnetically attracted and normally maintained in a first position relative to the base unit by the magnetic attraction of the base unit but movable about the axis from the first position to a second position relative to the base unit.

4. The magnetic mounting portion of claim 3 further comprising:

a magnet fixed in the base unit and providing magnetization for the base unit and attracting the offset portion of the antenna pedestal and normally maintaining said antenna pedestal in the first position abutting said base unit and opposing any externally applied torque tending to rotate said antenna pedestal about said axis of said hinge and away from said first position, but enabling maintenance of said first position to be overcome by the application of a sufficient torque on said antenna pedestal about the hinge axis in a direction tending to rotate the antenna pedestal away from the first position to the second position.

5. The magnetic mounting portion of claim 4 wherein, said offset portion includes an amount of ferromagnetic material wherein said antenna pedestal is capable of forming a magnetic bond with said base unit which restrains said antenna pedestal from rotating with respect to said base unit about said hinge.

6. The magnetic mounting portion of claim 5 further comprising:

means for connecting an antenna mounted upon said antenna pedestal to an appropriate item of radio equipment.

7. The magnetic mounting portion of claim 6 wherein, said means for connecting includes a coaxial cable having one end partially concealed within said antenna pedestal, and said antenna pedestal includes means for linking an antenna mounted upon said pedestal to said coaxial cable.

8. A method of securely mounting an antenna assembly on a vehicle in the face of certain disturbing forces and comprising the steps of:

providing an antenna assembly having a magnetic base unit producing a magnetic field, an antenna, a hinge which defines an axis of rotation interconnecting the base unit to the antenna, and a means for connecting the antenna to a radio;

mounting said assembly on a vehicle such that said axis of rotation is substantially parallel to an axle of the vehicle; and using the magnetic field of the base unit to hold the assembly to the vehicle and to hold the antenna erect relative to the base unit but enable folding the antenna about the hinge axis without moving the base unit relative to the vehicle.

* * * * *